United States Patent [19]

Vialaneix

[11] Patent Number: 5,053,737

[45] Date of Patent: Oct. 1, 1991

[54] LOW TENSION CONNECTING STRUCTURE FOR AN IGNITION COIL, IN PARTICULAR FOR AN INTERNAL COMBUSTION ENGINE OF AN AUTOMOTIVE VEHICLE

[75] Inventor: Dominique Vialaneix, Issoire, France

[73] Assignee: Valeo Electronique, Voisins-Le-Bretonneux, France

[21] Appl. No.: 619,982

[22] Filed: Nov. 30, 1990

[30] Foreign Application Priority Data

Dec. 6, 1989 [FR] France ..... 89 16102

[51] Int. Cl.[5] ..... H01F 27/04; H01F 15/10

[52] U.S. Cl. ..... 336/90; 336/107; 336/192; 336/198

[58] Field of Search ..... 336/107, 192, 198, 208, 336/92, 90; 310/71; 123/634

[56] References Cited

U.S. PATENT DOCUMENTS

| | | | |
|---|---|---|---|
| 3,189,857 | 6/1965 | Jones | 336/192 |
| 3,979,707 | 9/1976 | Prince, Jr. | 336/192 X |
| 4,519,015 | 5/1985 | Lin | 336/192 X |
| 4,720,646 | 1/1988 | Torimoto | 310/71 |
| 4,763,094 | 8/1988 | Kojima | 336/107 X |
| 4,766,406 | 8/1988 | Kurgan et al. | 336/192 X |

FOREIGN PATENT DOCUMENTS

| | | |
|---|---|---|
| 0255409 | 2/1988 | European Pat. Off. . |
| 0307703 | 3/1989 | European Pat. Off. . |

*Primary Examiner*—Thomas J. Kozma

*Attorney, Agent, or Firm*—Dennison, Meserole, Pollack & Scheiner

[57] ABSTRACT

An ignition coil, in particular for an internal combustion engine of an automotive vehicle, comprising a housing and a magnetic assembly integrated with the said housing, the magnetic assembly comprising a magnetic core mounted within a primary winding spool, a secondary winding spool coaxial with the primary winding spool, a primary winding, a secondary winding, a magnetic flux return circuit, low tension electrical supply means including a connector, and a plurality of connecting strips moulded onto the said connector and having ends on the outside of the said connector, and holding means for holding the said connector and connecting strips on the magnetic assembly, characterized in that the holding means are defined by the said ends of the connecting strips cooperating with slots formed in a flange of the secondary winding spool.

7 Claims, 4 Drawing Sheets

LOW TENSION CONNECTING STRUCTURE FOR AN IGNITION COIL, IN PARTICULAR FOR AN INTERNAL COMBUSTION ENGINE OF AN AUTOMOTIVE VEHICLE

FIELD OF THE INVENTION

This invention relates to an ignition coil, in particular for an internal combustion engine of an automotive vehicle, and is directed more particularly to a low tension electrical connecting structure for such a coil.

BACKGROUND OF THE INVENTION

It is well known that the secondary of an ignition coil produces a very high voltage to enable an electric arc to be generated between the electrodes of the spark plugs, so as to ignite the fuel/air mixture in the cylinders of the engine. Conventionally, all of the spark plugs are controlled from a single, common ignition coil through, for example, a mechanical distributor which is generally of the rotating arm type. A bundle of high tension cables is required in order to connect the secondary of the ignition coil to the distributor and to connect the distributor to each of the spark plugs.

Apart from the cost of the high tension cable bundle, the latter gives rise to electrical losses which produce parasotic radio waves. These may be acceptable if the distributor is of the mechanical type, but, where the ignition system is of the electronic type, the radio waves give rise to substantial perturbation in the ignition system itself.

In order to overcome these disadvantages, it has already been proposed to provide a separate ignition coil for each spark plug. Such an individual ignition coil, which may be referred to as a monocylinder coil, may comprise, in a known manner, a closed magnetic circuit assembly comprising a central magnetic core, around which two winding spools of plastics material are arranged coaxially, with primary and secondary windings being carried on the winding spools, and with this assembly being integrated into a housing which is formed by being moulded in plastics material around the magnetic circuit assembly. Synthetic resin is flowed into the interior of the housing so as to encaptulate the various elements of the ignition coil and to insulate them electrically from each other. The present invention is directed specifically to a monocylinder coil of this type.

In such a coil, the primary winding has to be supplied with low tension voltage. The low tension supply means are generally situated on the upper part of the ignition coil itself, and comprise connecting strips, one end of which is connected to the primary winding, by soldering or by any other means, with the other ends being located in the body of a connector. This connector is fixed on the body of the ignition coil, and provides the low tension electrical connection between the latter and the outside.

The angular orientation of this connector has to be determined according to the design of the particular vehicle in which the ignition coil is installed. In addition the connector may be of any one of a number of different forms, so that it is adapted to fit the design requirements of the particular vehicle concerned. The manufacturer of the ignition coil must therefore be prepared to provide a wide variety of different designs of connector in order to satisfy the requirements of his customers, the automobile manufacturers.

For obvious cost reasons, it is essential that the housing and the other components of the magnetic assembly should remain identical to each other regardless of the type of connector employed.

In addition, the electrical connections between the ends of the connecting strips and the ends of, in particular, the primary winding should be made before the magnetic assembly is introduced into the housing.

DISCUSSION OF THE INVENTION

In order to overcome these problems, the present invention proposes an ignition coil, in particular for an internal combustion engine of an automotive vehicle, comprising a housing and a magnetic assembly integrated with the said housing, the magnetic assembly comprising a magnetic core mounted within a primary winding spool, a secondary winding spool coaxial with the primary winding spool, a primary winding, a secondary winding, a magnetic flux return circuit, low tension electrical supply means including a connector and a plurality of connecting strips moulded onto the said connector and having ends on the outside of the said connector, and holding means for holding the said connector and connecting strips on the magnetic assembly, characterised in that the holding means are defined by the said ends of the connecting strips cooperating with slots formed in a flange of the secondary winding spool.

In this way, the magnetic assemblies may all be made identical with each other, while the low tension connector can be 'personalised' for each vehicle as required.

According to a preferred feature of the invention, the ends of the connecting strips are introduced into jaws which project respectively from primary inserts and from a secondary insert. The ends of the connecting strips are then gripped in the said jaws.

The invention facilitates automation of the making of the low tension electrical connections required, especially that with the primary winding, before the magnetic assembly is inserted into the housing of the coil.

The description which follows, given by way of example only and with reference to the accompanying drawings, will enable a better understanding to be obtained as to how the invention may be carried out in practice.

DESCRIPTION OF PREFERRED EMBODIMENT OF THE INVENTION

Figure 2:
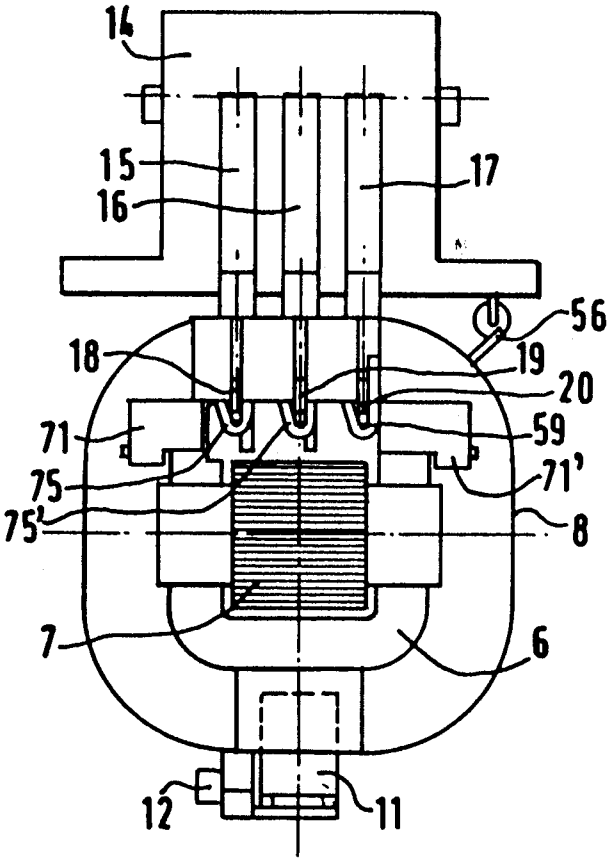
FIG. 2 is a view in cross section of the magnetic assembly before its introduction into the housing.

A monocylindrical ignition coil in accordance with the invention includes a housing 1 which is made of an insulating material. The base of the housing 1 is extended at its centre by an integral spigot 2. The spigot 2 is generally cylindrical in shape and includes a cavity in which the high tension output 3 is fixed. A magnetic flux return circuit 4 is formed from pressed and interleaved magnetic sheet metal laminations, and is incorporated by moulding into the housing 1 itself, so as to constitute in effect the metallic armature of the latter.

This coil completes the magnetic circuit, which also includes a primary winding 5 which is wound around a primary winding spool 6. A central magnetic core 7 is of rectangular shape (see FIG. 2) and consists generally of pressed and interleaved magnetic sheet metal laminations. The core 7 is housed within the primary winding spool 6. The assembly of the winding 5 with its spool 6 and core 7 will be referred to as the primary assembly P.

Around the primary assembly P, and arranged coaxially with the primary winding spool 6, there is arranged a secondary winding spool 8. A secondary winding 9 is wound around the secondary winding spool 8, and the winding 8 with its spool 9 will be referred to as the secondary assembly S. The secondary assembly S is held on and around the primary assembly P.

The primary assembly P and secondary assembly S are assembled one inside the other, and the magnetic circuit thus formed is adapted to be introduced into a cavity 10 of the housing 1. Before its introduction into this cavity 10, the low tension connections and also the high tension connection means are fitted onto this magnetic assembly.

The high tension connecting means make the electrical connection between the high tension end of the secondary winding 9 and the high tension output 3, which receives an intermediate sleeve for connecting it electrically with the spark plug (not shown) with which the ignition coil is associated. These high tension connection means comprise a cross piece 11, a high tension connecting plate 12, and a high tension insert 13, the connecting plate 12 being connected mechanically and therefore electrically to the insert 13, to which the high tension end of the secondary winding 9 is fixed. When the magnetic assembly is introduced into the housing 1, the high tension output member (in the form of a terminal 3) is secured by screwing it into the high tension connecting plate 12. These various elements do not form part of the present invention and will accordingly not be described in any further detail here.

Figure 3:
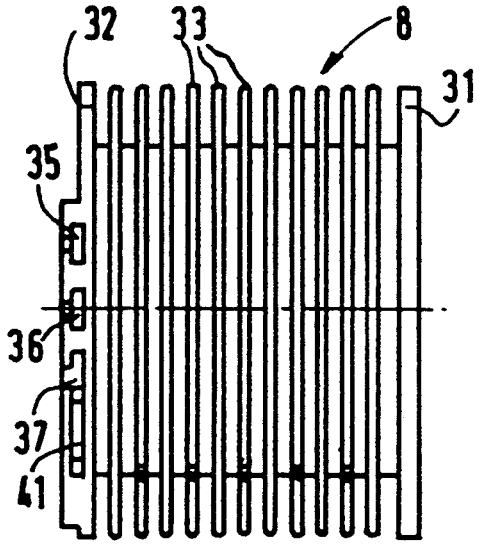
FIG. 3 is a plan view, from above, showing a secondary winding spool, as seen in the direction of the arrow F1 in FIG. 4.
Figure 4:
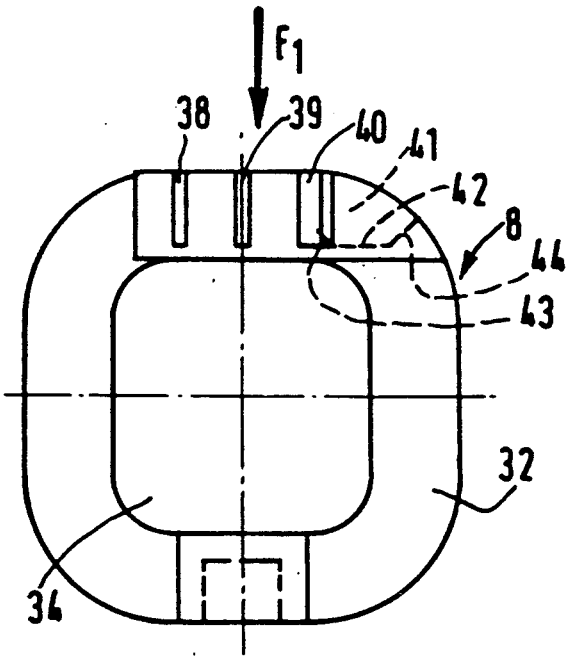
FIG. 4 is a front view of the secondary winding spool.

Reference is now made to FIGS. 3 and 4, which show the secondary winding spool 8, which is generally tubular in shape and which is formed by moulding in plastics material. An end flange, 31, 32 respectively, is formed at each of its ends. Over the whole outer periphery of the tubular core of the winding spool 8, the latter is divided up into compartments by means of a plurality of discs 33. The secondary winding 9 is a wire wound on the winding spool 8. The discs 33 enable the wires of the winding 9 to be wound over a substantial thickness. The secondary winding spool 8 also defines a tubular cavity 34 for receiving the primary assembly P.

Three recesses 35, 36 and 37 are formed in the end flange 32. Each of these recesses has a cross section in the general form of a T, and includes a slot 38, 39, 40 respectively which is open on the outer face of the end flange 32. The recess 37 is extended laterally in a slot 41, the base of which has a flared V-shaped form with a horizontal portion 42 and two inclined sections 43 and 44.

Figure 5:
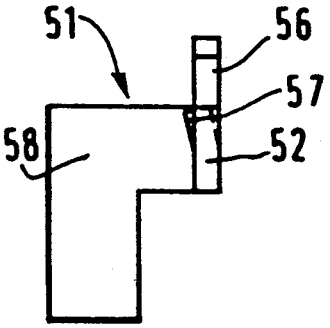
FIGS. 5, 6 and 7 are respectively a side or profile view, a front view, and a top plan view of a secondary insert.
Figure 6:
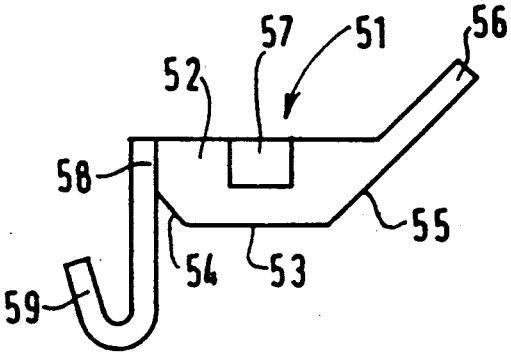
Figure 7:
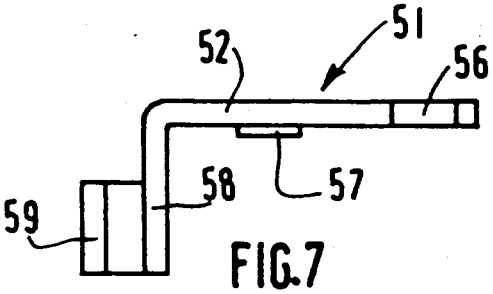

FIGS. 5 to 7 show an insert 51 for the low tension connection of the secondary winding. The insert 51 will be referred to in the rest of this description as the secondary insert. It is made of an electrically conductive metal by press forming, and has a vertical wall 52, the lower edge of which has a horizontal portion 53 and two inclined lateral portions 54 and 55. This vertical wall 52 is extended laterally on the side of the inclined portion 55, through an inclined branch 56. The vertical wall 52 also includes a press-formed tongue 57.

On the side of the inclined portion 54, the vertical wall 52 is extended in a wall 58, which is again vertical and which has a generally U-shaped claw 59 formed in its end by pressing and bending.

The secondary insert 51 is adapted to be force fitted into the slot 41 of the secondary winding spool 8. Its precise positioning is ensured by cooperation of the inclined portions 54 and 55 of the secondary insert 51 with the inclined sections 43 and 44 respectively in the base of the slot 41. The secondary insert 51 is maintained in position in the slot 41 by means of the tongue 57, which bears against one of the faces of the slot 41 and penetrates into the latter, thus resisting any removal of the secondary insert 51.

Figure 1:
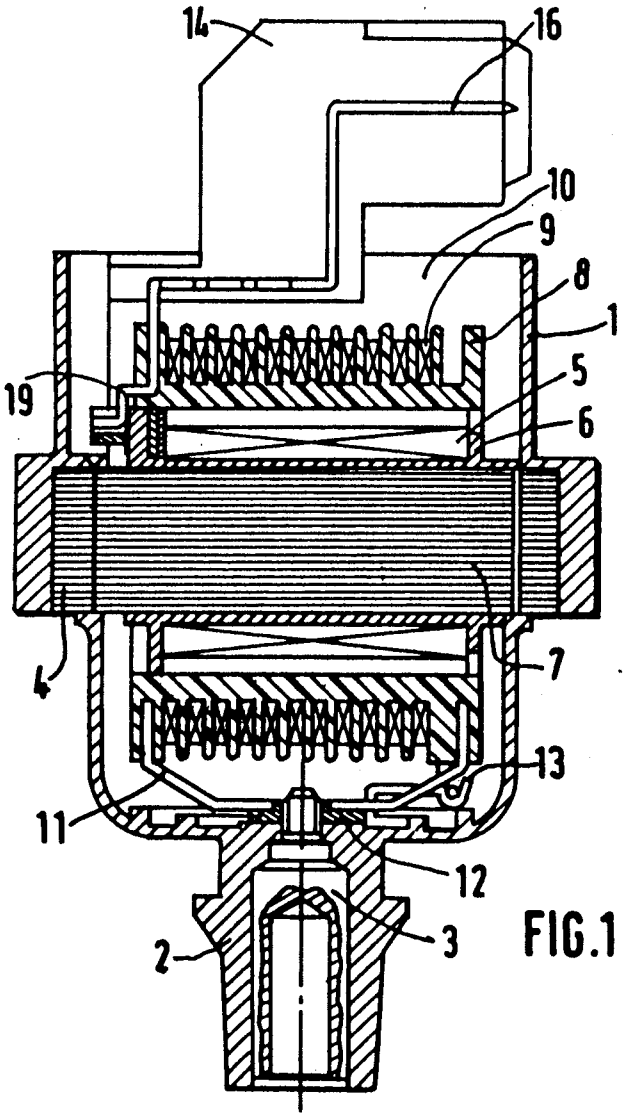
FIG. 1 is a view in cross section of an ignition coil which is constructed in accordance with the invention.
Figure 9:
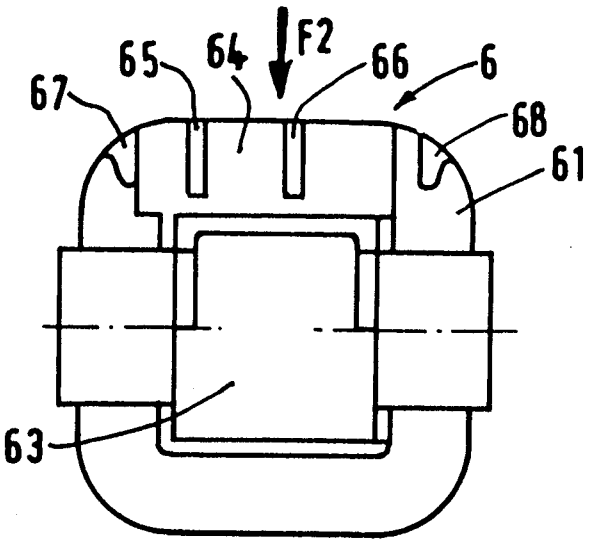
FIG. 9 is a front view of the primary winding spool.
Figure 8:
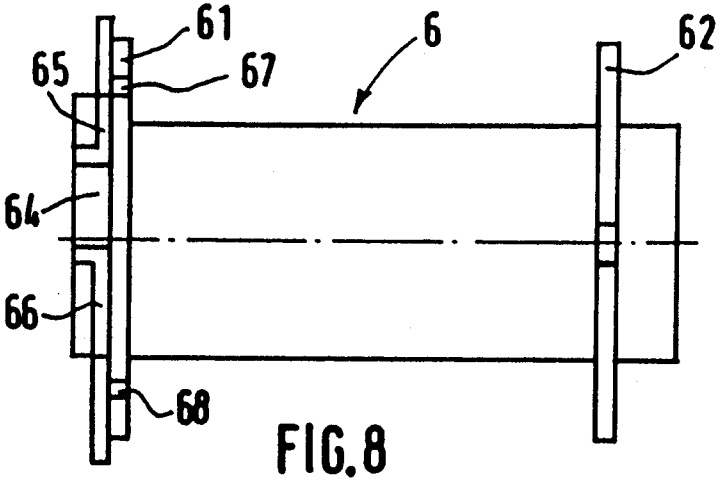
FIG. 8 is a top plan view of a primary winding spool, as seen in the direction of the arrow F2 in FIG. 9.

Reference is now made to FIGS. 8 and 9, which show the primary winding spool 6. This is again generally tubular in shape and is made by moulding in plastics material. It has a flange, 61, 62 respectively, at each end, and a rectangular central cavity 63 into which the central magnetic core 7 is inserted (FIG. 1). The upper part of the flange 61 is extended on the outside in an integral block 64 which is generally in the form of a parallelepiped. Two L-shaped slots 65 and 66 are formed in the block 64, and are open at the upper side and front of the latter. Two recesses 67 and 68 for accommodating the ends of the primary winding 5, are formed in the flange 61.

Figure 11:
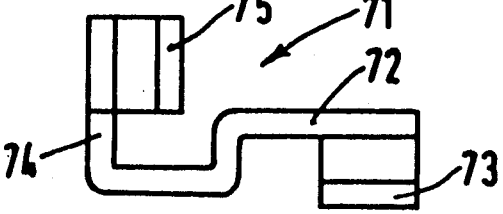
FIGS. 10, 11 and 12 are respectively a side or profile view, a front view, and a top plan view of one of the primary inserts.
Figure 10:
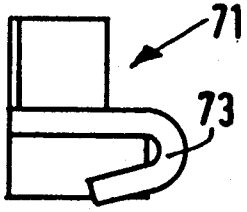
Figure 12:
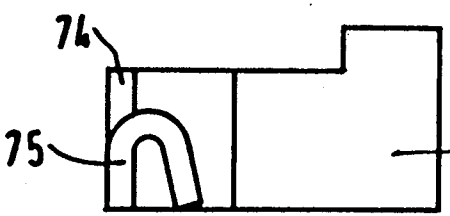

FIGS. 10 to 12 show one of the primary inserts 71, which are press formed in an electrically conductive material. The primary insert 71 includes a first branch 72, which has a U-shaped claw 73 formed at its end. The branch 72 is joined to a second branch 74 through three successive right angle bends. The end of the second branch 74 carries a claw 75, which is again U-shaped.

The ignition coil described above is supplied with low tension current through an external connector 14 (FIGS. 1 and 2). Connecting strips 15, 16 and 17 are mounted on the connector 14, and the ends, 18, 19 and 20 respectively, of these connecting strips are arranged to be connected respectively to the ends of the primary winding 5 and to the low tension end of the secondary winding 9. These connections should be made before the pre-assembled primary assembly P and secondary assembly S are introduced into the cavity 10 of the housing 1.

Thus, it is necessary that the assembly comprising the connector 14 with its connecting strips 15, 16, 17 should be held in position on the magnetic assembly so as to effect the required electrical connection. With this in view, the ends 18, 19 and 20 of the respective external connecting strips 15, 16 and 17 of the connector 14 include an L-shaped portion, the horizontal branch of which is of reduced width, this width corresponding to the slots 38, 39 and 40 of the corresponding recesses 35, 36 and 37 formed in the secondary winding spool 8.

The means by which the assembly comprising the connector 14 with its connecting strips 15 to 17 is held in position are defined by the cooperation of the ends 18 to 20 of these connecting strips with the recesses 35 to 37 of the secondary winding spool 8. The ends 18 to 20 are sufficiently rigid to support the connector 14, while the depth of the recesses 35 to 37 is large enough to reinforce their rigidity. In this way the assembly of the connector 14 with its connecting strips, positioned on the magnetic assembly, makes the required electrical connections.

Figure 13:
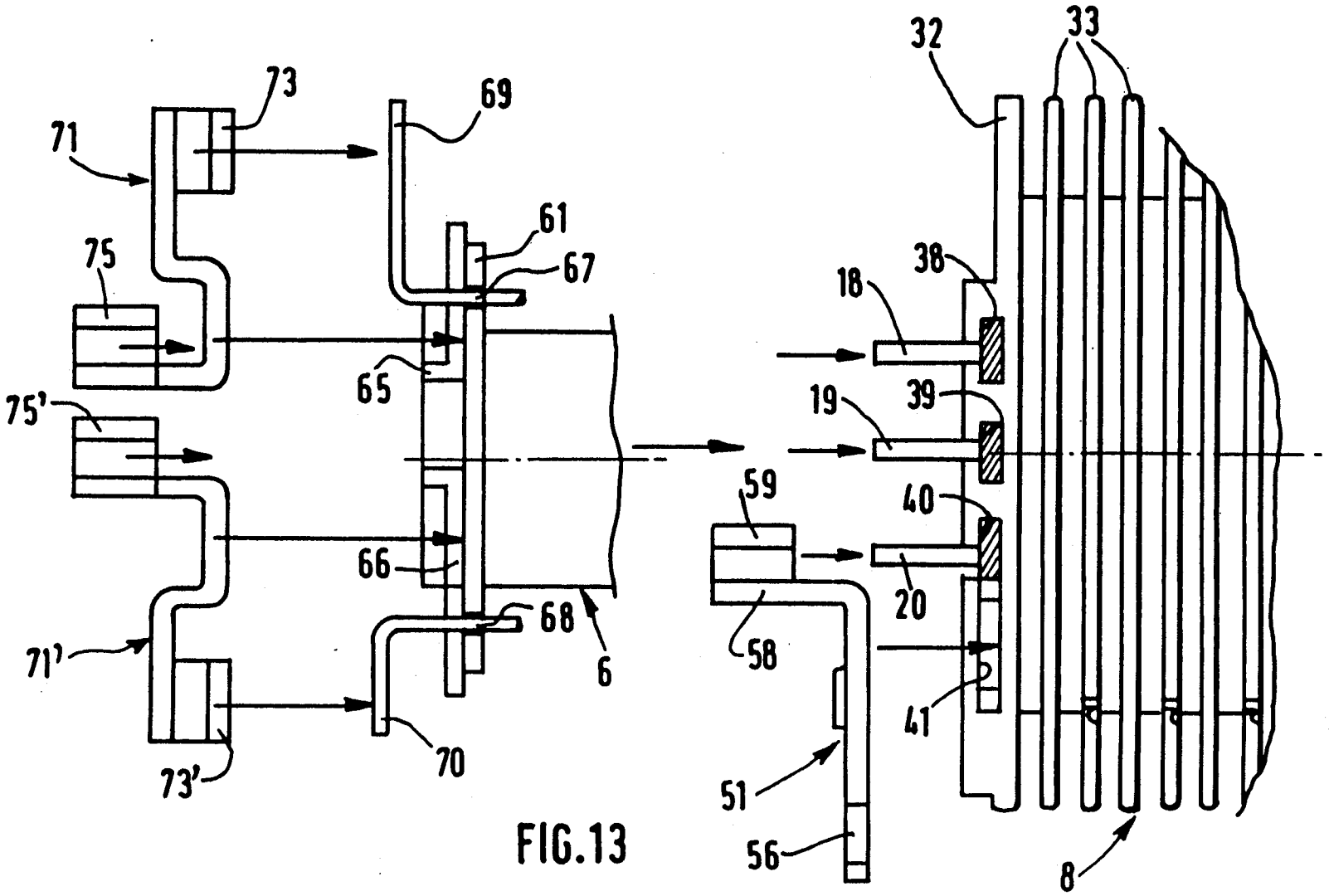
FIG. 13 is a top plan view showing the relationship between the various elements which constitute the low tension connection structure in accordance with the invention.

In order to give a better understanding as to how these electrical connections are made, reference is now made to FIG. 13, in which only the relevant reference numerals are marked. The primary winding spool 6 has primary inserts 71 and 71'. The primary insert 71' is symmetrical with, and of identical design, to the insert 71, so that it need not be described separately in detail.

The inserts 71 and 71' are force fitted into the L-shaped slots 65 and 66 of the primary winding spool 6. The ends 69 and 70 of the primary winding 5 are bent at right angles and are located in the respective jaws 73 and 73' of the primary inserts 71 and 71' in which they are gripped. In parallel, the secondary insert 51 is force fitted into the slot 41 of the secondary winding spool 8. Once the secondary winding 9 is complete, its low tension end is secured by winding and soldering onto the inclined branch 56 of the secondary insert 51.

The primary assembly P and the secondary assembly S are now complete, and are assembled together, after which the low tension connector 14, with its connecting strips 15 to 17, is positioned by introducing the ends 18 to 20 into the slots 38 to 40 of the secondary winding spool 8. The arrangement is then such that the ends 18 to 20 of the connecting strips 15 to 17 lie respectively in the jaws 75, 75' and 59 and are then gripped by these jaws. The electrical connections are finally completed by soldering.

As will be realised from the foregoing, all of the operations described are readily capable of being carried out automatically, and thereby lead to a reduction in the cost of the ignition coil.

What is claimed is:

1. An ignition coil for an internal combustion engine, comprising a housing, a primary winding spool in the housing, a primary winding on the primary winding spool, a magnetic assembly comprising a magnetic core located within the primary winding spool and a magnetic flux return circuit, low tension electrical supply means, and holding means mounting the said low tension supply means on the said magnetic assembly, wherein the low tension supply means include a connector and a plurality of connecting strips molded onto the said connector and defining ends which are external to the connector, a secondary winding on a spool having a flange with a plurality of first slots formed therein, and the said holding means being defined by the said ends of the connecting strips in said first slots, primary inserts in the primary winding spool and a secondary insert in the secondary winding spool, each primary insert having a first jaw and the secondary insert having a second jaw, said ends of two said connecting strips being introduced respectively into the first jaws and that a of a third said connecting strip being introduced into the second jaw.

2. An ignition coil according to claim 1, wherein the said ends of the connecting strips are gripped by the corresponding said jaws.

3. An ignition coil according to claim 2, wherein the primary winding spool has a flange having a plurality of L-shaped slots formed in it, the said primary inserts being force fitted into the said L-shaped slots so as to secure the primary inserts to the primary winding spool.

4. An ignition coil according to claim 3, wherein the ends of the primary winding are introduced into the said jaws of the primary inserts.

5. An ignition coil according to claim 4, wherein the said ends of the primary winding are gripped by the corresponding jaws.

6. An ignition coil according to claim 1, wherein the secondary insert has an integral pre-formed tongue, the secondary winding spool having a flange formed with a slot defining a slot wall, the tongue cooperating with the said slot wall so as to secure the secondary insert into the secondary winding spool.

7. An ignition coil according to claim 6, wherein the secondary insert has an inclined branch, the low tension end of the secondary winding being wound around or soldered to the inclined branch, or both wound around it and soldered to it, so as to secure the said low tension end.

* * * * *